US007988436B2

(12) United States Patent
Grigoriev

(10) Patent No.: US 7,988,436 B2
(45) Date of Patent: Aug. 2, 2011

(54) VANE MACHINE

(76) Inventor: Boris Yurievich Grigoriev, Saint Petersburg (RU)

( * ) Notice: Subject to any disclaimer, the term of this patent is extended or adjusted under 35 U.S.C. 154(b) by 331 days.

(21) Appl. No.: 12/300,119

(22) PCT Filed: May 16, 2007

(86) PCT No.: PCT/RU2007/000258

§ 371 (c)(1),
(2), (4) Date: Nov. 7, 2008

(87) PCT Pub. No.: WO2007/133122

PCT Pub. Date: Nov. 22, 2007

(65) Prior Publication Data

US 2009/0110582 A1 Apr. 30, 2009

(30) Foreign Application Priority Data

May 16, 2006 (RU) ..... 2006117225

(51) Int. Cl.

| | |
|---|---|
| ***F01C 1/00*** | (2006.01) |
| ***F03C 2/00*** | (2006.01) |
| ***F03C 4/00*** | (2006.01) |
| ***F04C 2/00*** | (2006.01) |

(52) U.S. Cl. ..... 418/150; 418/255

(58) Field of Classification Search ..... 418/150, 418/253–255, 259, 266–268

See application file for complete search history.

(56) References Cited

U.S. PATENT DOCUMENTS

| | | | | | |
|---|---|---|---|---|---|
| 1,442,198 | A * | 1/1923 | Utley et al. | ..... | 418/255 |
| 2,260,888 | A * | 10/1941 | Davis | ..... | 418/255 |
| 2,373,656 | A | 4/1945 | Brull | | |
| 2,491,352 | A * | 12/1949 | Zeitlin | ..... | 418/150 |
| 2,679,973 | A | 6/1954 | Berg | | |
| 3,386,387 | A * | 6/1968 | Eickmann | ..... | 418/255 |
| 6,236,897 | B1 * | 5/2001 | Lee et al. | ..... | 418/150 |

FOREIGN PATENT DOCUMENTS

| | | | | | |
|---|---|---|---|---|---|
| JP | 57195892 | A * | 12/1982 | ..... | 418/255 |
| JP | 60069206 | A * | 4/1985 | ..... | 418/150 |
| WO | WO 03/081049 | | 10/2003 | | |

* cited by examiner

*Primary Examiner* — Theresa Trieu

(74) *Attorney, Agent, or Firm* — Ronald R. Santucci; Frommer, Lawrence & Haug LLP

(57) ABSTRACT

A vane machine includes a housing with a inlet port and an outlet port, a rotor mounted in a cavity of the housing. The rotor has a faceplate and a guide cylinder mounted eccentrically on an end surface of the housing opposite to the faceplate. The guide cylinder is rotatable and provided with a diametrical face groove open from a side of the faceplate, and one or more working vanes mounted on the faceplate such that the faceplate is rotatable and movable in the grooves of the guide cylinder as the faceplate rotates. The diameter of the guide cylinder 7 is $D>4a-L$, where e is the eccentricity of the axis of the guide cylinder and the length of the working vane is $L \leqq 4e \times \sin 90°/N$, where N is the number of working vanes.

3 Claims, 2 Drawing Sheets

VANE MACHINE

This application is a 371 of PCT/RU2007/000258 filed on May 16, 2007, published on Nov. 22, 2007 under publication number WO 2007/133122 A2 which claims priority benefits from Russian Patent Application Number 2006117225 filed May 16, 2006, the disclosure of which is hereby incorporated by reference.

BACKGROUND OF THE INVENTION

This invention relates to mechanical engineering and can be used in hydraulic machines, pumps, compressors and internal combustion engines.

Known is a vane pump comprising a housing in which a barrel is fixed, the barrel being provided with suction and discharge ports, an inner cavity of the barrel comprising a rotor with radial grooves in which vanes are mounted, the vanes interacting with closers (Russian utility model patent RU 40466, Int. class F04C 2/344, published 10, Sep. 2004).

The vane pump of the prior art is characterized by some drawbacks which are structural complexity, insufficient reliability due to many friction couples, as well as inefficient pumping of the working medium.

Known is a vane machine comprising a rotor mounted eccentrically in a stator cavity, movable vanes being mounted in radial grooves of the rotor and rested on a cylindrical guide member received in a bore in the rotor (see Russian patent RU 2011013 Int. class F04C 2/344, published 15, Apr. 1994).

Among drawbacks of this vane machine are complex structure, extensive wear of movable vanes, and inefficient pumping of the working medium.

Known is a pump comprising a housing having a cavity formed therein and provided with an inlet port and an outlet port, a rotor mounted eccentrically in the cavity, blades extending diametrically through the rotor, engaged with the walls of the cavity and dividing the same into a plurality of working chambers, wherein the cross-section of the cavity being a combination of two arches of a circle with different radii and two adjacent curvilinear sections which are complementary portions of Archimedean spiral of common foci, each of the arches being less than half of a circle. Ends of these curvilinear sections are tangentially directed to said arches of a circle in the points of intersection with them, each of the blades moving at a constant velocity as it travels over the non-circular portion of the cavity while sliding through the rotor, the rotor rotating at a constant angular velocity and fitting an arch of a circle of lesser radius (see U.S. Pat. No. 2,260,888 A, 28, Oct. 1941, F04c2/344). Each blade of the pump mounted in the rotor is capable of being free longitudinally moved relative to the axis of the rotor, the distance of its longitudinal moving being limited by three parameters, namely the blade surface groove space, the eccentricity of the rotor axis relative to the axis of the inner cavity of the housing and the shape of the cross-section of the housing cavity. The trajectory of the moving of the blades ends is specified by the shape of the cross-section of the housing cavity in this pump.

This pump also shows complex structure, extensive wear of movable vanes and inefficient pumping of the working medium.

A rotary apparatus as disclosed in U.S. Pat. No. 2,373,656 A, 17, Apr. 1945, F04C 2/344 can be regarded as the closest prior art by construction and technical effect. The rotary apparatus comprises a stator and a rotor. The stator comprises a cylindrical housing, and the inner surface of this housing has a general cross-section in the form of a cardioid, except for a part in which the wall is provided with a longitudinal arcuate recess. The rotor comprises a cylindrical shuttle and a blade, the shuttle being adapted for rotation in the housing in such a way that a part of the shuttle enters the recess. The shuttle has a longitudinal diametrical slot in which the blade is mounted for transversal movement therein, the blade having such a length that its edge engages the inner surface of the housing as the shuttle rotates. At either side of the recess, the housing is provided with an inlet port and an outlet port each having a width equal to the thickness of the blade. Further, the rotary apparatus is provided with control means for controlling the blade movement to allow the edge of the blade to sweep the inner surface of the housing, the control means being independent of the shuttle. Thus rotary apparatus is still characterized by inefficient pumping of the working medium. Another its drawback is narrow use due to the cardioid cross-section of the housing inner surface and a limited width of the inlet and outlet ports restricted by the thickness of the working vane.

BRIEF SUMMARY OF THE INVENTION

The purpose this invention is to create a new design of a vane machine featured by highly efficient pumping of the working medium and a wide use.

The above purpose is achieved by providing a vane machine comprising a housing with an inlet port and an outlet port, a rotor mounted in a cavity of said housing, the rotor being constituted by a faceplate, a guide cylinder mounted eccentrically on the end surface of the housing opposite to the faceplate, the guide cylinder being adapted for rotation and provided with a diametrical face groove open from the side of the faceplate; and a working vane mounted on the faceplate and adapted for free rotation and movement in the groove of the guide cylinder as the faceplate rotates, wherein the eccentricity of the rotation axis of the working vane is equal to the eccentricity of the rotation axis of the guide cylinder and wherein, according to the invention, a plurality of working vanes and grooves, both the vanes and the grooves, both the vanes and the grooves, respectively, being equal in size, is provided, the profile of the housing cavity is one of an oval shape, cylindrical shape, epicycloidal shape, and curved shape, and the diameter of the guide cylinder is $D>4e-L$, where e is an eccentricity of the axis of the guide cylinder, where the length of the working vane is $L\leqq 4e\times\sin 90°/N$, where N is the number of the working vanes.

In the vane machine according to the invention the faceplate may be coaxial to the axis of the housing cavity.

In the vane machine according to the invention the faceplate may be eccentrical to the housing cavity axis.

Providing a plurality of working vanes and providing in the guide cylinder a plurality of grooves, both the vanes and the grooves, respectively, being equal in size, wherein the guide cylinder diameter $D>4e-L$ and the working vane length $L\leqq 4e\times\sin 90°/N$ results in highly efficient pumping of the working medium in the vane machine according to the invention.

Oval, cylindrical, epicycloidal or curved profile of the housing cavity as well as coaxial or eccentrical mount of the faceplate with respect to the axis of the housing cavity result in wide use of the vane machine according to the invention. A suitable shape of the housing cavity and orientation of the faceplate with respect to the housing cavity axis can be selected for use in hydraulic machines, pumps for pumping various working mediums, air compressors and internal combustions engines.

The aforementioned advantages make this invention outstanding compared to the prior art.

BRIEF DESCRIPTION OF TILE DRAWINGS

The patent application is illustrated by the attached drawings, where

DETAILED DESCRIPTION

Figure 1:
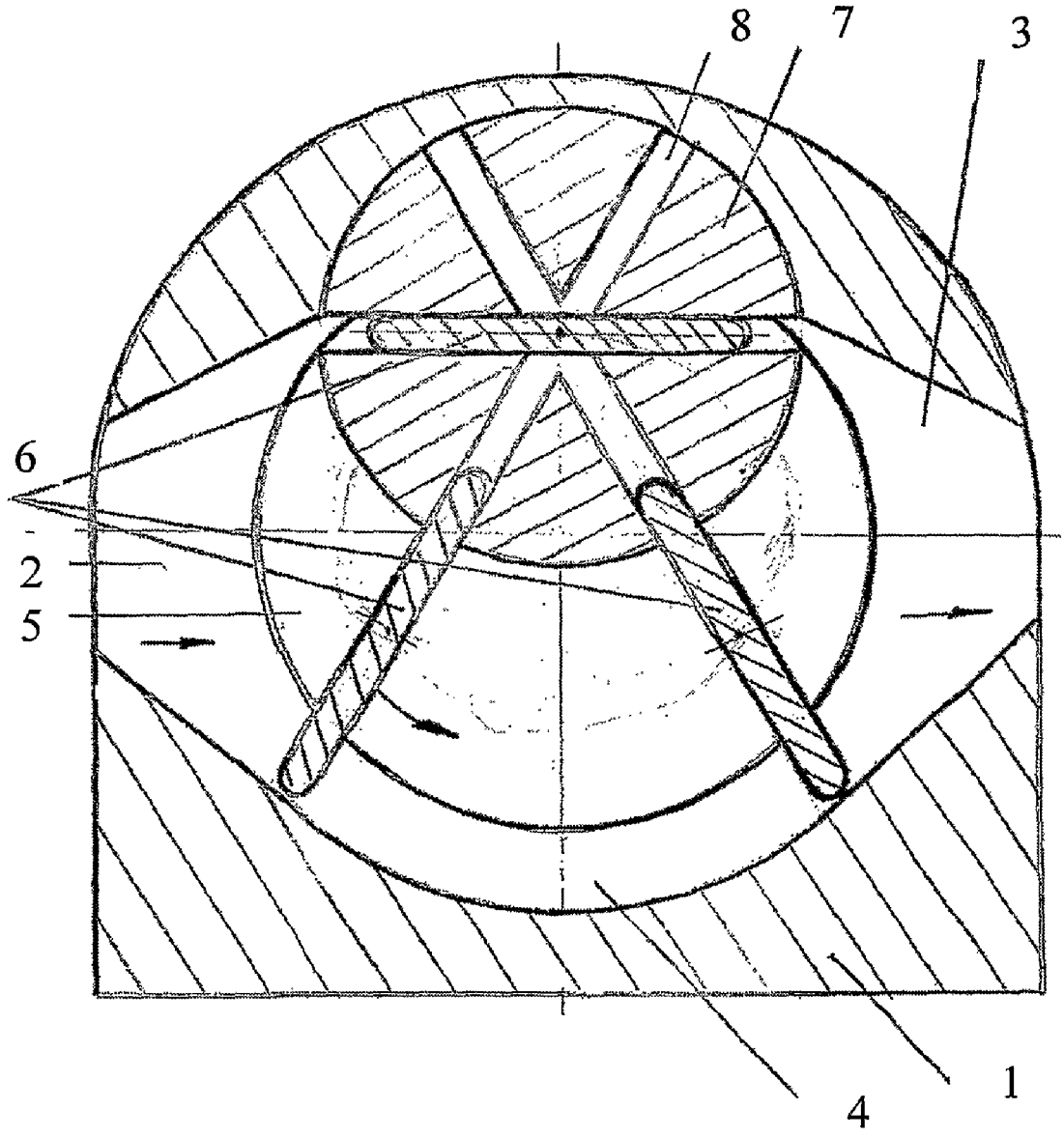
FIG. 1 is a general cross-sectional view of the vane machine according to the invention.
Figure 2:
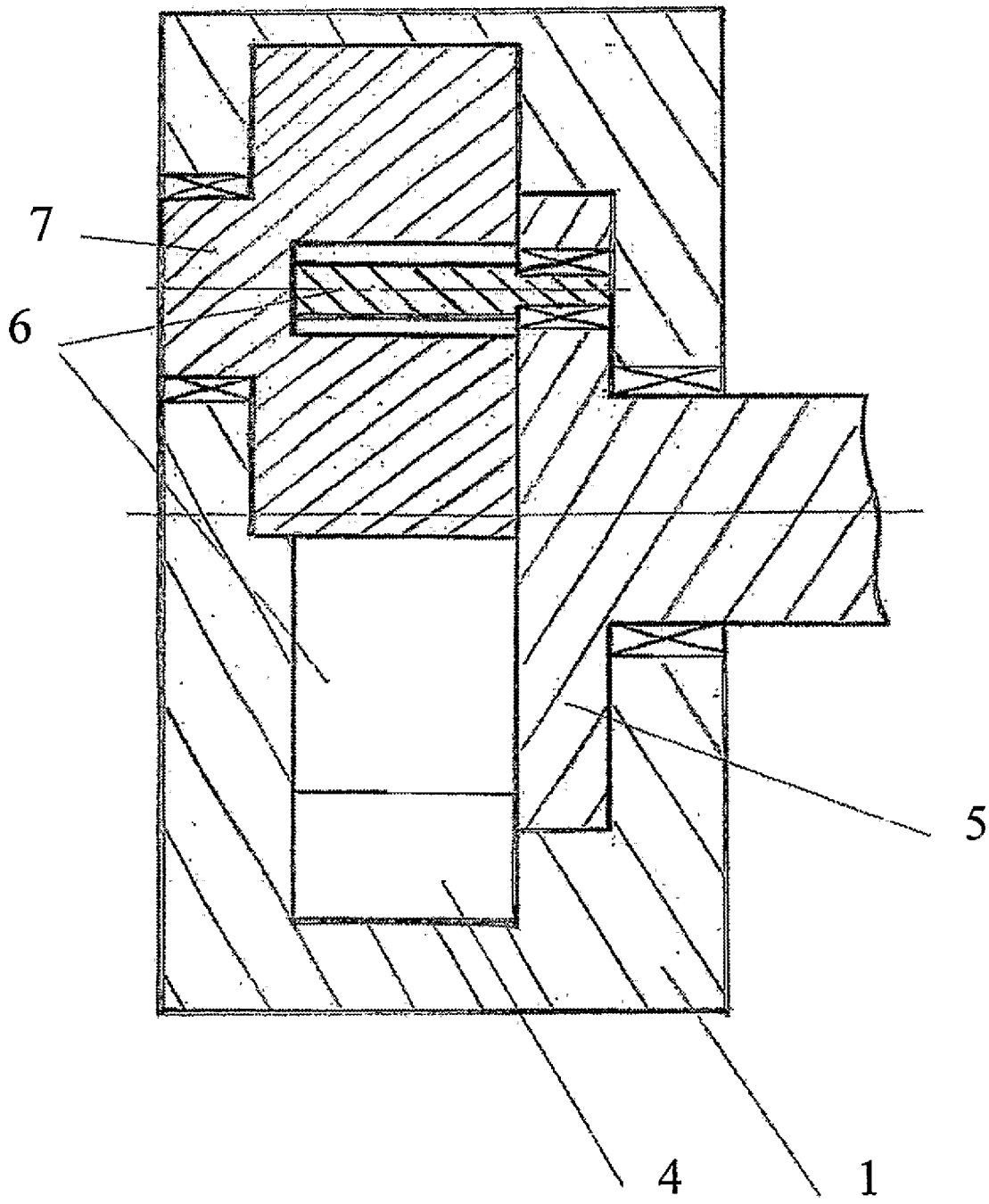
FIG. 2 is a side elevation of the vane machine according to the invention.

A vane machine comprises a housing 1 with a inlet port 2 and an outlet port 3, a rotor mounted in a cavity 4 of the housing 1, the rotor being constituted by a faceplate 5, a guide cylinder 7 mounted eccentrically on the end surface of the housing 1 opposite to the faceplate 5, the guide cylinder 7 being rotatable and provided with a diametrical face groove 8 open from the side of the faceplate 5, and a working vane 6 mounted on the faceplate 5 and adapted for free rotation and movement in the groove 8 of the guide cylinder 7 as the faceplate 5 rotates. The eccentricity of the rotation axis of the working vanes 6 is equal to the eccentricity of the rotation axis of the guide cylinder 7. A plurality of working vanes 6 and grooves 8, both vanes 6 and grooves 8, both the vanes and the grooves, respectively, being equal in size, is provided, the profile of the cavity 4 of the housing 1 is oval, cylindrical, epicycloidal or curved, and the diameter of the guide cylinder 7 is $D>4e-L$, while the length of the working vane 6 is $L\leqq 4e\times\sin 90°/N$.

In such a vane machine according to the invention the faceplate 5 may be mounted coaxially to the axis of the cavity 4 of the housing 1.

In such a vane machine according to the invention the faceplate 5 can be mounted eccentrically to the axis of the cavity 4 of the housing 1.

The vane machine operates as described below.

When the faceplate 5 rotates, the working vanes 6 move in diametrical face groves 8 of the guide cylinder 7 and rotate in the working cavity 4 of the housing 1. At the same time, a vacuum is generated in the area of the inlet port 2. Therefore, the working medium coming through the inlet port 2 is captured by the working vanes 6 and is transferred, under excessive pressure, through the working cavity 4 of the housing 1 to the outlet port 3.

When the working vanes 6 move progressively in the grooves 8 of the guide cylinder 7, their ends are most close to each other when the centers of two working vanes 6 nearest to the center of rotation of the guide cylinder 7 are equidistant from this center. In any other position, the distance between the ends of the working vanes will be longer.

To avoid intersection of the ends of the working vanes 6 in the grooves of the guide cylinder, their length must comply with the following relation: $L\leqq 4e\times\sin 90°/N$.

At the same time, the diameter of the guide cylinder 7 must comply with the relation: $D>4e-L$. If this relation is violated, the end of the working vane 6, which is the furthest from the guide cylinder 7, does not engage with the corresponding groove 8 of the guide cylinder 7, and the device according to the invention is inoperative.

The abovementioned relations obtained experimentally ensure a highly efficient pumping of the working medium.

While comparing the machine according to this invention with the prior art distinguishing features and, therefore, novelty can be detected.

These distinguishing features result in a positive effect of providing a new vane machine having a simple design and wide use and showing highly efficient pumping of the working medium.

This vane machine is industrially applicable because it can be used in mechanical engineering and particularly in hydraulic machines, pumps, compressors and internal combustion engines.

The invention claimed is:

1. A vane machine comprising a housing with an inlet port and an outlet port, a rotor mounted in a cavity of said housing, the rotor being constituted by a faceplate, a guide cylinder mounted eccentrically on an end surface of the housing opposite to the faceplate, the guide cylinder being rotatable and provided with a face diametrical groove open from a side of the faceplate, and a working vane mounted on the faceplate such that the faceplate is rotatable and movable in the groove of the guide cylinder as the faceplate rotates, wherein an eccentricity of a rotation axis of the working vane is equal to an eccentricity of the rotation axis of the guide cylinder, wherein a plurality of working vanes and grooves, both the vanes and the grooves, respectively, being equal in size, is provided, a profile of the cavity of the housing is one of an oval shape, cylindrical shape, epicycloidal shape, and curved shape, and a diameter of the guide cylinder is $D>4e-L$, where e is an eccentricity of the axis of the guide cylinder, where a length of the working vane is $L\leqq 4e\times\sin 90°/N$, where N is the number of working vanes.

2. A vane machine as claimed in claim 1 wherein the faceplate is coaxial to an axis of the cavity of the housing.

3. A vane machine as claimed in claim 1 wherein the faceplate is mounted eccentrically to an axis of the cavity of the housing.

* * * * *